US011766067B2

(12) United States Patent
Digard et al.

(10) Patent No.: US 11,766,067 B2
(45) Date of Patent: Sep. 26, 2023

(54) GROUND TOBACCO COMPOSITION

(71) Applicant: Nicoventures Trading Limited, London (GB)

(72) Inventors: Helena Digard, London (GB); Marina Sintyureva, London (GB); Francis Cheung, London (GB); Geoff Foss-Smith, London (GB)

(73) Assignee: Nicoventures Trading Limited, London (GB)

( * ) Notice: Subject to any disclaimer, the term of this patent is extended or adjusted under 35 U.S.C. 154(b) by 214 days.

(21) Appl. No.: 16/614,267

(22) PCT Filed: May 9, 2018

(86) PCT No.: PCT/EP2018/062116
§ 371 (c)(1),
(2) Date: Nov. 15, 2019

(87) PCT Pub. No.: WO2018/210675
PCT Pub. Date: Nov. 22, 2018

(65) Prior Publication Data

US 2020/0146334 A1 May 14, 2020

(30) Foreign Application Priority Data

May 15, 2017 (GB) ..... 1707758

(51) Int. Cl.
*A24B 15/24* (2006.01)
*A24B 13/00* (2006.01)
*A24B 15/28* (2006.01)

(52) U.S. Cl.
CPC ..... *A24B 15/24* (2013.01); *A24B 15/285* (2013.01); *A24B 13/00* (2013.01)

(58) Field of Classification Search
None
See application file for complete search history.

(56) References Cited

U.S. PATENT DOCUMENTS

| | | | | |
|---|---|---|---|---|
| RE12,994 | E | 7/1909 | Gloystein | |
| 3,880,172 | A | 4/1975 | Anderson et al. | |
| 4,153,063 | A | 5/1979 | Roselius et al. | |
| 4,506,682 | A | 3/1985 | Mueller | |
| 4,561,452 | A | 12/1985 | Gaehrs | |
| 4,727,889 | A | 3/1988 | Niven et al. | |
| 4,756,318 | A | 7/1988 | Clearman et al. | |
| 5,018,540 | A | 5/1991 | Grubbs et al. | |
| 5,025,812 | A | 6/1991 | Fagg et al. | |
| 5,073,267 | A | 12/1991 | Adda et al. | |
| 5,119,835 | A | 6/1992 | Heemann et al. | |
| 5,318,050 | A | 6/1994 | Gonzalez-Parra et al. | |
| 5,435,325 | A | 7/1995 | Clapp et al. | |
| 5,497,792 | A | 3/1996 | Prasad et al. | |
| 5,617,881 | A | 4/1997 | Kossmehl et al. | |
| 7,726,320 | B2 | 6/2010 | Robinson et al. | |
| 8,479,747 | B2 | 7/2013 | OConnell | |
| 8,887,737 | B2 | 11/2014 | Howell et al. | |
| 9,554,595 | B2 | 1/2017 | Buchberger | |
| 10,123,560 | B2 * | 11/2018 | Rasouli | A24D 1/00 |
| 10,375,996 | B2 | 8/2019 | Aoun et al. | |
| 10,426,199 | B2 | 10/2019 | Turner et al. | |
| 11,511,056 | B2 | 11/2022 | Hepworth et al. | |
| 11,612,702 | B2 | 3/2023 | Bowen et al. | |
| 2004/0025891 | A1 | 2/2004 | McAdam et al. | |
| 2006/0196517 | A1 * | 9/2006 | Gedevanishvili | A24B 15/42 131/360 |
| 2007/0023058 | A1 | 2/2007 | Howell et al. | |
| 2007/0137663 | A1 | 6/2007 | Taylor et al. | |
| 2007/0193595 | A1 | 8/2007 | Haruki et al. | |
| 2008/0257367 | A1 | 10/2008 | Paterno et al. | |
| 2009/0032036 | A1 | 2/2009 | Uematsu et al. | |
| 2011/0159160 | A1 | 6/2011 | Jonsson et al. | |
| 2011/0259353 | A1 | 10/2011 | Coleman et al. | |
| 2012/0006341 | A1 | 1/2012 | Schmekel et al. | |
| 2012/0125354 | A1 | 5/2012 | Byrd et al. | |
| 2012/0145170 | A1 | 6/2012 | OConnell | |
| 2012/0152265 | A1 | 6/2012 | Dube et al. | |
| 2012/0167901 | A1 * | 7/2012 | Onno | A24B 13/00 131/111 |
| 2012/0199145 | A1 | 8/2012 | Byrd et al. | |
| 2012/0318287 | A1 * | 12/2012 | Andersen | A24B 15/16 131/355 |
| 2013/0008457 | A1 | 1/2013 | Zheng et al. | |

(Continued)

FOREIGN PATENT DOCUMENTS

| | | |
|---|---|---|
| CN | 1440699 A | 9/2003 |
| CN | 1440699 A | 9/2003 |

(Continued)

OTHER PUBLICATIONS

Boiling Points and Structures of Hydrocarbons, Virtual Chembook , Elmhurst College, 2003, [online], retrieved from the Internet, [retrieved Apr. 27, 2022], <URL: chemistry.elmhurst.edu/vchembook/501hcboilingpts.html>. (Year: 2003).*

International Search Report and Written Opinion for Application No. PCT/EP2018/062121, dated Jul. 30, 2018, 14 pages.

Marcolli C., et al., "Water Activity in Polyol/Water Systems: New UNIFAC Parameterization," Atmospheric Chemistry and Physics, Copernicus GMBH, Germany, Retrieved from the Internet: URL: http://www.atmos-chemphys.net/5/1545/2005/acp-5-1545-2005.pdf, [retrieved on Nov. 26, 2014], vol. 5 (6), Jun. 1, 2005, pp. 1545-1555.

Office Action for Japanese Application No. 2019-562889, dated Dec. 8, 2020, 6 pages.

(Continued)

*Primary Examiner* — Dennis R Cordray

(74) *Attorney, Agent, or Firm* — Patterson Thuente PA

(57) ABSTRACT

Embodiments described herein include a ground tobacco composition, wherein at least 90% by weight of the tobacco in the composition has a particle size in the range of about 200 μm to about 5 mm.

5 Claims, No Drawings

(56) References Cited

U.S. PATENT DOCUMENTS

| | | | | |
|---|---|---|---|---|
| 2013/0160777 | A1 | 6/2013 | Murphy | |
| 2013/0239981 | A1 | 9/2013 | Liu et al. | |
| 2013/0255702 | A1 | 10/2013 | Griffith et al. | |
| 2014/0096780 | A1 | 4/2014 | Gerardi | |
| 2014/0190500 | A1 | 7/2014 | Duan et al. | |
| 2014/0238396 | A1 | 8/2014 | Buchberger | |
| 2014/0261483 | A1 | 9/2014 | Hopps | |
| 2015/0027453 | A1* | 1/2015 | Tessmann | A24B 15/18 131/300 |
| 2015/0150305 | A1 | 6/2015 | Shenkal | |
| 2015/0374035 | A1 | 12/2015 | Sanchez et al. | |
| 2016/0081395 | A1 | 3/2016 | Thorens et al. | |
| 2016/0100626 | A1 | 4/2016 | Ishida | |
| 2016/0106144 | A1* | 4/2016 | Muehlbauer | A24B 15/26 131/352 |
| 2016/0205992 | A1 | 7/2016 | Bell et al. | |
| 2019/0320718 | A1 | 10/2019 | Yilmaz et al. | |
| 2021/0106051 | A1 | 4/2021 | Han et al. | |

FOREIGN PATENT DOCUMENTS

| | | | |
|---|---|---|---|
| CN | 1459256 | A | 12/2003 |
| CN | 1459256 | A | 12/2003 |
| CN | 1899142 | A | 1/2007 |
| CN | 1899142 | A | 1/2007 |
| CN | 101247739 | A | 8/2008 |
| CN | 101247739 | A | 8/2008 |
| CN | 101338248 | A | 1/2009 |
| CN | 101338248 | A | 1/2009 |
| CN | 101830941 | A | 9/2010 |
| CN | 101830941 | A | 9/2010 |
| CN | 102106602 | A | 6/2011 |
| CN | 102106602 | A | 6/2011 |
| CN | 102199490 | A | 9/2011 |
| CN | 102199490 | A | 9/2011 |
| CN | 102326859 | A | 1/2012 |
| CN | 102326859 | A | 1/2012 |
| CN | 102488318 | A | 6/2012 |
| CN | 102488318 | A | 6/2012 |
| CN | 102640985 | A | 8/2012 |
| CN | 102640985 | A | 8/2012 |
| CN | 102894469 | A | 1/2013 |
| CN | 102894469 | A | 1/2013 |
| CN | 102994228 | A | 3/2013 |
| CN | 102994228 | A | 3/2013 |
| CN | 103060094 | A | 4/2013 |
| CN | 103060094 | A | 4/2013 |
| CN | 103230094 | A | 8/2013 |
| CN | 103230094 | A | 8/2013 |
| CN | 103235066 | A | 8/2013 |
| CN | 103242960 | A | 8/2013 |
| CN | 103242960 | A | 8/2013 |
| CN | 103462206 | A | 12/2013 |
| CN | 103462206 | A | 12/2013 |
| CN | 103468403 | A | 12/2013 |
| CN | 103468403 | A | 12/2013 |
| CN | 103484245 | A | 1/2014 |
| CN | 103484245 | A | 1/2014 |
| CN | 103720030 | A | 4/2014 |
| CN | 103720030 | A | 4/2014 |
| CN | 103783651 | A | 5/2014 |
| CN | 103783651 | A | 5/2014 |
| CN | 103783660 | A | 5/2014 |
| CN | 103783660 | A | 5/2014 |
| CN | 103235066 | B | 6/2014 |
| CN | 103881817 | A | 6/2014 |
| CN | 103881817 | A | 6/2014 |
| CN | 104489912 | A | 4/2015 |
| CN | 104489912 | A | 4/2015 |
| CN | 105641970 | A | 6/2016 |
| DE | 554139 | C | 7/1932 |
| DE | 554139 | C | 7/1932 |
| EP | 0280817 | A2 | 9/1988 |
| EP | 0280817 | A2 | 9/1988 |
| EP | 0323699 | A2 | 7/1989 |
| EP | 0323699 | A2 | 7/1989 |
| EP | 0338831 | A2 | 10/1989 |
| EP | 0338831 | A2 | 10/1989 |
| EP | 0434333 | A2 | 6/1991 |
| EP | 0434333 | A2 | 6/1991 |
| EP | 0443761 | A1 | 8/1991 |
| EP | 0443761 | A1 | 8/1991 |
| EP | 0822247 | A2 | 2/1998 |
| EP | 0822247 | A2 | 2/1998 |
| EP | 0845220 | A1 | 6/1998 |
| EP | 0941140 | B1 | 11/2002 |
| EP | 0941140 | B1 | 11/2002 |
| EP | 0845220 | B1 | 9/2003 |
| EP | 1355708 | A2 | 10/2003 |
| EP | 1355708 | A2 | 10/2003 |
| EP | 1267650 | B1 | 12/2005 |
| EP | 1267650 | B1 | 12/2005 |
| EP | 1815899 | A1 | 8/2007 |
| EP | 1815899 | A1 | 8/2007 |
| EP | 1915064 | A2 | 4/2008 |
| EP | 1915064 | A2 | 4/2008 |
| EP | 1980163 | A1 | 10/2008 |
| EP | 1980163 | A1 | 10/2008 |
| EP | 2303425 | A1 | 4/2011 |
| EP | 2303425 | A1 | 4/2011 |
| EP | 2544560 | A1 | 1/2013 |
| EP | 2544560 | A1 | 1/2013 |
| EP | 2560509 | A1 | 2/2013 |
| EP | 2560509 | A1 | 2/2013 |
| EP | 2008534 | B1 | 7/2013 |
| EP | 2008534 | B1 | 7/2013 |
| EP | 2640204 | A1 | 9/2013 |
| EP | 2640204 | A1 | 9/2013 |
| EP | 2523568 | B1 | 12/2013 |
| EP | 2523568 | B1 | 12/2013 |
| EP | 2727477 | A2 | 5/2014 |
| EP | 2727477 | A2 | 5/2014 |
| EP | 1951074 | B1 | 7/2014 |
| EP | 1951074 | B1 | 7/2014 |
| EP | 2769631 | A1 | 8/2014 |
| EP | 2769631 | A1 | 8/2014 |
| EP | 1915064 | B1 | 4/2017 |
| GB | 1357645 | A | 6/1974 |
| GB | 2173985 | A | 10/1986 |
| GB | 2173985 | A | 10/1986 |
| GB | 2515883 | | 1/2015 |
| GB | 2515883 | A | 1/2015 |
| JP | S519838 | A | 1/1976 |
| JP | S519838 | A | 1/1976 |
| JP | S62176504 | A | 8/1987 |
| JP | S62176504 | A | 8/1987 |
| JP | S63229102 | A | 9/1988 |
| JP | S63229102 | A | 9/1988 |
| JP | H0249572 | A | 2/1990 |
| JP | H0249572 | A | 2/1990 |
| JP | H03127975 | A | 5/1991 |
| JP | H03127975 | A | 5/1991 |
| JP | H069986 | A | 1/1994 |
| JP | H069986 | A | 1/1994 |
| JP | H0698746 | A | 4/1994 |
| JP | H0698746 | A | 4/1994 |
| JP | H07227502 | A | 8/1995 |
| JP | H07227502 | A | 8/1995 |
| JP | H0819389 | A | 1/1996 |
| JP | H0819389 | A | 1/1996 |
| JP | H0823952 | A | 1/1996 |
| JP | H0823952 | A | 1/1996 |
| JP | H0910502 | A | 1/1997 |
| JP | H0910502 | A | 1/1997 |
| JP | 3014704 | B2 | 2/2000 |
| JP | 3014704 | B2 | 2/2000 |
| JP | 3223058 | B2 | 10/2001 |
| JP | 3223058 | B2 | 10/2001 |
| JP | 2001276603 | A | 10/2001 |
| JP | 2001276603 | A | 10/2001 |
| JP | 3325028 | B2 | 9/2002 |
| JP | 3325028 | B2 | 9/2002 |
| JP | 2005532821 | A | 11/2005 |

(56) References Cited

FOREIGN PATENT DOCUMENTS

| | | | |
|---|---|---|---|
| JP | 2005532821 | A | 11/2005 |
| JP | 2007136404 | A | 6/2007 |
| JP | 2007136404 | A | 6/2007 |
| JP | 2008055255 | A | 3/2008 |
| JP | 2008055255 | A | 3/2008 |
| JP | 2009502160 | A | 1/2009 |
| JP | 2009502160 | A | 1/2009 |
| JP | 2014530633 | A | 11/2014 |
| JP | 2014530633 | A | 11/2014 |
| JP | 2017511703 | A | 4/2017 |
| JP | 2017511703 | A | 4/2017 |
| KR | 20170040787 | A | 4/2017 |
| KR | 20170040787 | A | 4/2017 |
| KR | 20170046938 | A | 5/2017 |
| KR | 20170046938 | A | 5/2017 |
| RU | 2250717 | C2 | 4/2005 |
| RU | 2250717 | C2 | 4/2005 |
| RU | 2250718 | C2 | 4/2005 |
| RU | 2250718 | C2 | 4/2005 |
| RU | 2250724 | C2 | 4/2005 |
| RU | 2250724 | C2 | 4/2005 |
| RU | 2250734 | C2 | 4/2005 |
| RU | 2250734 | C2 | 4/2005 |
| RU | 2250739 | C2 | 4/2005 |
| RU | 2250739 | C2 | 4/2005 |
| WO | 9808584 | A1 | 3/1998 |
| WO | WO-9808584 | A1 | 3/1998 |
| WO | 0165954 | A1 | 9/2001 |
| WO | WO-0165954 | A1 | 9/2001 |
| WO | 0226343 | A2 | 4/2002 |
| WO | WO-0226343 | A2 | 4/2002 |
| WO | 2004008888 | A1 | 1/2004 |
| WO | WO-2004008888 | A1 | 1/2004 |
| WO | 2007052159 | A2 | 5/2007 |
| WO | 2007053096 | A1 | 5/2007 |
| WO | 2007053097 | A1 | 5/2007 |
| WO | 2007053098 | A1 | 5/2007 |
| WO | WO-2007052159 | A2 | 5/2007 |
| WO | WO-2007053096 | A1 | 5/2007 |
| WO | WO-2007053097 | A1 | 5/2007 |
| WO | WO-2007053098 | A1 | 5/2007 |
| WO | 2008026446 | A1 | 3/2008 |
| WO | WO-2008026446 | A1 | 3/2008 |
| WO | 2009019514 | A2 | 2/2009 |
| WO | WO-2009019514 | A2 | 2/2009 |
| WO | 2009156763 | A1 | 12/2009 |
| WO | WO-2009156763 | A1 | 12/2009 |
| WO | 2011088171 | A2 | 7/2011 |
| WO | WO-2011088171 | A2 | 7/2011 |
| WO | 2011110843 | A1 | 9/2011 |
| WO | 2011133633 | A1 | 10/2011 |
| WO | WO-2011133633 | A1 | 10/2011 |
| WO | 2012068375 | A1 | 5/2012 |
| WO | 2012174677 | A1 | 12/2012 |
| WO | WO-2012174677 | A1 | 12/2012 |
| WO | 2013060827 | A1 | 5/2013 |
| WO | WO-2013060827 | A1 | 5/2013 |
| WO | 2013142483 | A1 | 9/2013 |
| WO | WO-2013142483 | A1 | 9/2013 |
| WO | 2013187402 | A1 | 12/2013 |
| WO | WO 2013187402 | | 12/2013 |
| WO | 2014058837 | A1 | 4/2014 |
| WO | WO-2014058837 | A1 | 4/2014 |
| WO | 2014094337 | A1 | 6/2014 |
| WO | WO-2014094337 | A1 | 6/2014 |
| WO | 2015107552 | A1 | 7/2015 |
| WO | WO-2015107552 | A1 | 7/2015 |
| WO | 2015177177 | A1 | 11/2015 |
| WO | WO-2015177177 | A1 | 11/2015 |
| WO | 2016005709 | A1 | 1/2016 |
| WO | WO-2016005709 | A1 | 1/2016 |
| WO | 2016024083 | A1 | 2/2016 |
| WO | WO-2016024083 | A1 | 2/2016 |
| WO | 2016062777 | A1 | 4/2016 |
| WO | WO-2016062777 | A1 | 4/2016 |
| WO | 2016135331 | A1 | 9/2016 |
| WO | 2016184977 | A1 | 11/2016 |
| WO | WO-2016184977 | A1 | 11/2016 |
| WO | 2018210675 | A1 | 11/2018 |
| WO | 2018210676 | A1 | 11/2018 |
| WO | 2018210677 | A1 | 11/2018 |
| WO | 2018210678 | A1 | 11/2018 |
| WO | 2018210679 | A1 | 11/2018 |
| WO | 2018210680 | A1 | 11/2018 |
| WO | 2018210681 | A2 | 11/2018 |

OTHER PUBLICATIONS

Office Action dated Feb. 2, 2021 for Japanese Application No. 2019-562273, 12 pages.

International Search Report and Written Opinion, Application No. PCT/EP2018/062116, dated Aug. 20, 2018, 22 pages.

"Anonymous: "iFUSE—The Heat not Burn Hybrid—Heat Not Burn," Jan. 4, 2017 (Jan. 4, 2017), XP055493889. Retrieved from the Internet: URL: https://heatnotburn.co.uk/ifuse-heat-not-burnhybrid/ [retrieved on Jul. 19, 2018]", pp. 1-15.

"Anonymous: "Where Does the Nicotine Used in Electronic Cigarettes Come From?," Quora—Aug. 23, 2015 (Aug. 23, 2015), XP055494026", Retrieved from the Internet: URL: https://www.quora.com/Where-does-the-nicotine-used-in-electronic-cigarettes-come-from, [retrieved on Jul. 19, 2018], 2 pages.

"Application and File History for U.S. Appl. No. 16/614,111, filed Nov. 15, 2019, Inventor Marina Sintyureva."

"Application and File History for U.S. Appl. No. 16/614,119, filed Nov. 15, 2019, Inventor Helena Digard."

"Application and File History for U.S. Appl. No. 16/614,267, filed Nov. 15, 2019, Inventor Helena Digard et al."

"Application and File History for U.S. Appl. No. 16/614,269, filed Nov. 15, 2019, Inventor Helena Digard et al."

"Application and File History for U.S. Appl. No. 16/614,270, filed Nov. 15, 2019, Inventor Geoff Foss-Smith et al."

"Application and File History for U.S. Appl. No. 16/614,274, filed Nov. 15, 2019, Inventor Marina Sintyureva."

"Application and File History for U.S. Appl. No. 16/614,276, filed Nov. 15, 2019, Inventor Marina Sintyureva et al."

"Boiling Points and Structures of Hydrocarbons", 2003, [online], Virtual Chembook, Elmhurst College, Retrieved from, http://chemistry.elmhurst.edu/vchembook/501 hcboilingpts.html, on Apr. 27, 2022, 1 page.

"Definition of Through", Merriam-Webster Dictionary, https://www.merriam-webster.com/dictionary/through, 2022, 9 pages.

"International Preliminary Report on Patentability for Application No. PCT/EP2018/062116, dated Nov. 28, 2019", 8 pages.

"International Preliminary Report on Patentability for Application No. PCT/EP2018/062117, dated Nov. 28, 2019", 8 pages.

"International Preliminary Report on Patentability for Application No. PCT/EP2018/062119, dated Nov. 28, 2019", 8 pages.

"International Preliminary Report on Patentability for Application No. PCT/EP2018/062120, dated Nov. 28, 2019", 9 pages.

"International Preliminary Report on Patentability for Application No. PCT/EP2018/062121, dated Nov. 28, 2019", 8 pages.

"International Preliminary Report on Patentability for Application No. PCT/EP2018/062122, dated Nov. 28, 2019", 9 pages.

"International Preliminary Report on Patentability for Application No. PCT/EP2018/062123, dated Nov. 28, 2019", 10 pages.

"International Search Report and Written Opinion for Application No. PCT/EP2018/062116, dated Aug. 20, 2018", 22 pages.

"International Search Report and Written Opinion for Application No. PCT/EP2018/062117, dated Jul. 31, 2018", 14 pages.

"International Search Report and Written Opinion for Application No. PCT/EP2018/062119, dated Jul. 30, 2018", 10 pages.

"International Search Report and Written Opinion for Application No. PCT/EP2018/062120, dated Jul. 30, 2018", 15 pages.

"International Search Report and Written Opinion for Application No. PCT/EP2018/062122, dated Jul. 31, 2018", 15 pages.

"International Search Report and Written Opinion for Application No. PCT/EP2018/062123, dated Nov. 28, 2018", 19 pages.

(56) References Cited

OTHER PUBLICATIONS

"International Search Report and Written Opinion received for PCT Patent Application No. PCT/EP2018/062121, dated Jul. 30, 2018", 11 pages.
"Marcolli C., et al., "Water Activity in Polyol/Water Systems: New UNIFAC Parameterization," Atmospheric Chemistry and Physics, Copernicus GmbH, Germany", Retrieved from the Internet: URL: http://www.atmos-chemphys.neU5/1545/2005/acp-5-1545-2005.pdf, [retrieved on Nov. 26, 2014], vol. 5 (6), Jun. 1, 2005, pp. 1545-1555.
"Munters., "Sieve Trays," 2022, Retrieved from the Internet: https://www.munters.com/en/munters/products/mass-transfer/sieve-trays/", 4 pages.
"Notice of Reasons for Refusal for Japanese Application No. 2019-562269, dated Mar. 2, 2021", 12 pages.
"Office Action for Canadian Application No. 3,062,987, dated Oct. 7, 2022", 4 pages.
"Office Action for Japanese Application No. 2019-562270, dated Dec. 8, 2020", 6 pages.
"Office Action for Japanese Application No. 2019-562289, dated Dec. 8, 2020", 6 pages.
"Office Action for Japanese Application No. 2019-562304, dated Dec. 1, 2020", 6 pages.
"Office Action for Japanese Application No. 2019-562384, dated Dec. 1, 2020", 5 pages.
"Office Action for Korean Application No. 10-2019-7033531, dated Aug. 24, 2021", 12 pages.
"Office Action for Korean Application No. 10-2019-7033532 dated Feb. 7, 2021", 9 pages.
"Office Action for Korean Application No. 10-2019-7033534, dated Aug. 24, 2021", 13 pages.
"Office Action for Korean Application No. 10-2019-7033535, dated Aug. 24, 2021", 12 pages.
"Office Action for Korean Application No. 10-2019-7033533, dated Aug. 24, 2021", 12 pages.
"Office Action dated Feb. 2, 2021 for Japanese Application No. 2019-562273", 24 pages.
"Office Action dated Apr. 24, 2020 for Russian Application No. 2019136484", 18 pages.
"Office Action dated Dec. 8, 2020 for Japanese Application No. 2019-562289", 6 pages.
"Search Report for Japanese Application No. 2019-562269, dated Feb. 17, 2021", 20 pages.
"Tray Column & Tray Types", Plant operations: Trays Types, 2016, Retrieved from the Internet: http://www.separationprocesses.com/Operations/POT_Chp02a.htm, 2 pages.
"Search Report received for Chinese Patent Application No. 201880032692.4, dated Jun. 25, 2021", 1 page (English Translation Only).

* cited by examiner

GROUND TOBACCO COMPOSITION

PRIORITY CLAIM

The present application is a National Phase entry of PCT Application No. PCT/EP2018/062116, filed May 9, 2018, which claims priority from GB Patent Application No. 1707758.7, filed May 15, 2017, which is hereby fully incorporated herein by reference.

TECHNICAL FIELD

The present invention relates to a ground tobacco composition which is particularly useful in the preparation of a tobacco extract, and methods of making the ground tobacco composition. The invention also provides a tobacco extract formed from the ground tobacco composition, cartridges containing the tobacco extract for use in a smoking article, and smoking articles comprising the tobacco extract.

BACKGROUND

Tobacco material is heated in smoking articles for the purpose of releasing substances contained in the material and delivering these as an aerosol.

Smoking articles such as cigarettes, cigars and the like burn tobacco during use to create tobacco smoke. Attempts have been made to provide alternatives to these articles that burn tobacco by creating products that release compounds without burning. Examples of such products are heating devices which release compounds by heating, but not burning, material. The material may be, for example, tobacco or other non-tobacco products, which may or may not contain nicotine.

Electronic cigarettes or "e-cigarettes" are another product that has been formulated as an alternative to combustible products. These devices contain a volatilizable solution which generates an inhalable aerosol on heating. These solutions may contain components of tobacco. It is therefore useful to be able to selectively extract tobacco components.

SUMMARY

According to a first aspect of the present invention, there is provided a ground tobacco composition, wherein at least 90% by weight of the tobacco in the composition has a particle size in the range of about 200 μm to about 5 mm.

When extracting components from tobacco, the particle size of the tobacco determines the distance that the tobacco components must diffuse within the tobacco leaf matrix in order to be extracted. Reduction of diffusional resistance by breaking tobacco leaf into small particles increases the rate of leaching of tobacco constituents out of the tobacco. Furthermore, this increases the tobacco surface area thereby increasing contact between the tobacco and extraction solvent.

The inventors have also found that through using a finely ground tobacco, the distribution of tobacco components through the ground tobacco is more consistent and any resulting extract composition has improved consistency, as compared to tobacco extracts obtained from ground tobacco with a larger particle sizes.

On the other hand, extraction solvents flow through a bed of ground tobacco during the extraction process. The separation between particles is greater for larger particles, allowing improved solvent flow and consequently more efficient extraction. Moreover, a narrow particle size distribution improves solvent flow; a wider range of particle sizes can result in a tobacco bed in which small tobacco particles fill spaces between larger particles thereby blocking solvent flow.

Further, very fine particles are more likely to be carried in a solvent flow during extraction, contaminating the tobacco extract and/or soiling the extraction equipment.

Balancing these various considerations, the inventors have optimized the particle size and particle size distribution for ground tobacco which is to be subjected to one or more extraction processes.

In some cases, at least 90% by weight of the tobacco in the composition has a particle size in the range of about 355 μm to about 3.5 mm.

The inventors have found that the concentration of benzo[a]pyrene and the concentration of metals is higher in tobacco particles having a size of less than 355 μm than in particles having a size of 355 μm or more. As a result of removing tobacco particles having a size of less than 355 μm, the extract obtained by extraction from this ground tobacco composition, depending on the extraction solvent, typically contains less metal and/or benzo[a]pyrene than tobacco extracts obtained from previously known ground tobacco compositions.

In some cases, at least 95% by weight of the tobacco in the composition has a particle size in the specified range, suitably at least 97% by weight.

According to a second aspect of the invention, there is provided a method of preparing a ground tobacco composition as described herein, the method comprising;

(a) grinding tobacco; (b) removing tobacco particles that are larger than the particle size range using a first sieve; and (c) removing tobacco particles that are smaller than the particle size range using a second sieve.

According to a third aspect of the invention, there is provided a tobacco extract obtainable by extracting tobacco components from the ground tobacco composition described herein.

A fourth aspect of the invention provides a method of preparing a tobacco extract, the method comprising contacting a solvent with the ground tobacco composition described herein. In some cases, the method of preparing a tobacco extract comprises (a) grinding tobacco; (b) removing tobacco particles that are larger than the particle size range using a first sieve; (c) removing tobacco particles that are smaller than the particle size range using a second sieve; and (d) contacting the ground tobacco with an extraction solvent.

A fifth aspect of the invention provide a cartridge configured for use in a smoking article, the cartridge containing a tobacco extract according to the third aspect of the invention. A further aspect of the invention provides a smoking article containing a tobacco extract according to the third aspect of the invention or a cartridge according to the fifth aspect of the invention.

Further features and advantages of the invention will become apparent from the following description of preferred embodiments of the invention, given by way of example only.

DETAILED DESCRIPTION

The invention provides a ground tobacco composition, wherein at least 90% by weight of the tobacco in the composition has a particle size in the range of about 200 μm 5 to about 5 mm. In some cases, at least 90% by weight of the tobacco in the composition as a particle size that exceeds about 250 μm, 300 μm, 330 μm or 355 μm. In some cases, at least 90% by weight of the tobacco in the composition has a particle size that is less than about 4.5 mm, 4 mm or 3.5 mm. For instance, in some cases at least 90% by weight of the tobacco in the composition has a particle size in the range of about 300 μm to about 4 mm, suitably from about 355 μm to about 3.5 mm.

As used herein, reference to a lower particle size limit means that the tobacco particles will not pass through a sieve with a mesh size of that lower limit. For instance, restriction of the particle size to be greater than 200 μm means that the particles are retained on a sieve with a 200 μm mesh. Similarly, restriction of the particle size to be greater than 355 μm means that the particles are retained on a sieve with a 355 μm mesh.

As used herein, reference to an upper particle size limit means that the tobacco particles will pass through a sieve with a mesh size of that upper limit. For instance, restriction of the particle size to be less than 5 mm means that the particles are not retained on a sieve with a 5 mm mesh (i.e. they pass through a 5 mm mesh sieve). Similarly, restriction of the particle size to be less than 3.5 mm means that the particles are not retained on a sieve with a 3.5 mm mesh (i.e. they pass through a 3.5 mm mesh sieve).

In some cases at least 95% by weight of the tobacco in the composition has a particle size in the specified range, and suitably at least 97%, 98%, 99% or 99.5% by weight of the tobacco in the composition has a particle size in the specified range. In some cases, substantially all of the tobacco in the composition has a particle size in the specified range. In some cases, 100% by weight of the tobacco in the composition has a particle size in the specified range.

The ground tobacco composition is particularly suitable for use in the preparation of a tobacco extract. Any suitable extraction solvent may be used. In some cases, the extraction solvent may be an aerosol generating agent, so that the tobacco components are dissolved and retained in the aerosol generating agent. A tobacco extract formed using an aerosol generating agent as a solvent can be incorporated directly into an electronic cigarette or the like (or a cartridge configured for use with an electronic cigarette). In other cases, the extraction solvent may be, for example, a supercritical fluid, such as supercritical carbon dioxide. Where the extraction solvent is not an aerosol generating agent, the method of preparing a tobacco extract according to the invention may include a solvent switch in which the dissolved tobacco components are transferred from the extraction solvent to an aerosol generating agent. As used herein, an "aerosol generating agent" is an agent that promotes the generation of an aerosol on heating. An aerosol generating agent may promote the generation of an aerosol by promoting an initial vaporization and/or the condensation of a gas to an inhalable solid and/or liquid aerosol.

In general, suitable aerosol generating agents include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate. In some cases, the aerosol generating agent comprises one or more of glycerol, propylene glycol, triacetin and isopropyl myristate, suitably glycerol and/or propylene glycol.

EXAMPLE

The tobacco moisture content should be in the range of 0-30% by weight, ideally 12-16% by weight. Tobacco was fed into a ball mill type grinder, Urschel Comitrol 3600 with a 3 mm round cutting head.

The particles were then sieved to select particles of the desired size. The ground tobacco was then separated using two sieves; a first, upper sieve with a 3.5 mm mesh size and a second, lower sieve with a 0.355 mm mesh size.

Tobacco particles retained on the top sieve can be retained and returned to the grinder later.

Tobacco particles retained on the lower sieve were retained as the sample for extraction.

Tobacco particles passing through both sieves were discarded. The equipment used for sieving is a Russell Finex 17300 sieve.

Comparison of the starting tobacco material (pre-grinding) with the tobacco particles of sample for extraction shows there is no loss of nicotine or water during the processing steps. Further, the metal content of the starting tobacco material and the tobacco particles of Sample A is the comparable; there is not metal leaching from the processing apparatus into the tobacco.

Moreover, samples taken from different parts of a tobacco leaf were determined to have significant variations in the relative concentrations of various tobacco components. The ground tobacco of the sample for extraction was found to have reduced variation in the concentration of these components as compared to the tobacco leaf.

Chemical and Physical Analysis

Various tests were completed using Virginia tobacco and, separately, Burley Tobacco. The tests were completed following grinding and the various size bands were selected using appropriate sieves. The data are shown below.

a) Chemical Composition.

It can be seen from Tables 1 and 2 below that the concentration of benzo[a]pyrene and toxic heavy metals is highest in tobacco extracts obtained using tobacco particles that are smaller than 355 μm.

TABLE 1

| Leaf Type | Particle size | Benzo[a]pyrene in extract (ng/g) |
|---|---|---|
| Virginia | 200-355 μm | 116 |
| | 355-710 μm | 100 |
| | 710-1400 μm | 89.8 |
| | >1400 μm | 90.8 |
| | All sizes | 93.4 |
| Burley | 200-355 μm | 5.26 |
| | 355-710 μm | 4.06 |
| | 710-1400 μm | 3.79 |
| | >1400 μm | 3.79 |
| | All sizes | 4.02 |

TABLE 2

| Leaf Type | Particle size | Concentration in extract (ng/g) | | | | | | |
|---|---|---|---|---|---|---|---|---|
| | | Cd | Pb | Cr | Ni | As | Se | Hg |
| Virginia | 200-355 μm | 962 | 870 | 1932 | 951 | 350 | 52.4 | 22.3 |
| | 355-710 μm | 786 | 238 | 402 | 369 | 70.4 | 41.7 | 18.6 |
| | 710-1400 μm | 788 | 262 | 329 | 345 | 58.7 | 42.1 | 17.8 |
| | >1400 μm | 723 | 255 | 441 | 402 | 60 | 38 | 15.3 |
| | All sizes | 747 | 244 | 411 | 373 | 80.4 | 42.6 | 16.1 |
| Burley | 200-355 μm | 196 | 673 | 4001 | 1993 | 158 | 23.2 | 16.2 |
| | 355-710 μm | 220 | 156 | 646 | 868 | 38.4 | 32.4 | 16.9 |
| | 710-1400 μm | 198 | 159 | 542 | 799 | 37.8 | 29.2 | 14.8 |
| | >1400 μm | 219 | 206 | 602 | 897 | 37.0 | 32.3 | 14.1 |
| | All sizes | 206 | 269 | 1104 | 1018 | 73 | 32.5 | 15.4 |

It can be seen from Table 3 below that the nicotine and moisture content was approximately equal for tobacco extracts obtained from all particle sizes.

TABLE 3

| Leaf Type | Particle size | Nicotine (mg/mL) | Water (wt %) |
|---|---|---|---|
| Virginia | 200-355 μm | 27.6 | 12.1 |
| | 355-800 μm | 31.0 | 13.2 |
| | 800-2000 μm | 31.6 | 13.6 |
| | >2000 μm | 32.9 | 14.0 |
| | All sizes | 33.3 | 13.7 |
| Burley | 125-355 μm | 26.8 | 10.0 |
| | 355-710 μm | 31.4 | 12.2 |
| | 710-1400 μm | 31.7 | 12.7 |
| | >1400 μm | 30.2 | 12.9 |
| | All sizes | 31.9 | 12.3 |

Tobacco extracts were formed by contacting tobacco particles with a 50:50 (w/w) mixture of glycerol and propylene glycol at 100° C. for 15 minutes. (The weight ratio of tobacco to solvent was 1:9). The nicotine concentration in the extracts was approximately the same for all particle size ranges used. The tobacco particle size does not affect the extract nicotine concentration.

b) Size Distribution

The particle size distribution following grinding was measured. The various size bands were selected using appropriate sieves.

| Leaf Type | Particle size | Wt % |
|---|---|---|
| Virginia | <200 μm | 1.3 |
| | 200-355 μm | 1.4 |
| | 355-710 μm | 10 |
| | 710-1400 μm | 29.5 |
| | >1400 μm | 57.8 |
| | All sizes | 100 |
| Burley | <200 μm | 1.4 |
| | 200-355 μm | 1.8 |
| | 355-710 μm | 17.4 |
| | 710-1400 μm | 42.3 |
| | >1400 μm | 37.1 |
| | All sizes | 100 |

It can be seen that 2.7wt % of the Virginia tobacco and 3.2wt % of the Burley tobacco had a particle size of less than 355 μm.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A method of preparing a tobacco extract from a ground tobacco composition, wherein at least 90% by weight of the tobacco in the composition has a particle size in the range of about 200 μm to about 5 mm, and wherein the ground tobacco composition is contacted with an extraction solvent comprising an aerosol generating agent selected from the group consisting of glycerol, propylene glycol, triacetin and isopropyl myristate.

2. The method of claim 1, wherein at least 90% by weight of the tobacco in the composition has a particle size in the range of about 355 μm to about 3.5 mm.

3. The method of claim 1, wherein at least 95% by weight of the tobacco has a particle size in the range of about 200 μm to about 5 mm.

4. The method of claim 1, the method comprising the steps of:

(a) grinding tobacco;

(b) removing tobacco particles that are larger than the particle size range using a first sieve; and (c) removing tobacco particles that are smaller than the particle size range using a second sieve.

5. The method of claim 1, wherein at least 97% by weight of the tobacco has a particle size in the range of about 200 μm to about 5 mm.

* * * * *